United States Patent [19]

Kirkendall

[11] Patent Number: 4,812,054

[45] Date of Patent: Mar. 14, 1989

[54] INSULATED BEVERAGE BOX CARRIER

[76] Inventor: Vern S. Kirkendall, 783 Portal Dr., Chico, Calif. 95926

[21] Appl. No.: 228,945

[22] Filed: Aug. 5, 1988

[51] Int. Cl.[4] ..... B65D 30/08; B65D 81/38

[52] U.S. Cl. ..... 383/110; 383/66; 62/457

[58] Field of Search ..... 383/18, 66, 95, 97, 383/109, 110; 62/457

[56] References Cited

U.S. PATENT DOCUMENTS

| | | | |
|---|---|---|---|
| 1,537,829 | 5/1925 | Kandle | 62/297 |
| 2,289,254 | 7/1942 | Eagles | 150/52 F |
| 3,443,397 | 5/1969 | Donovan et al. | 62/398 |
| 3,965,953 | 6/1976 | Becker et al. | 383/66 X |
| 4,197,890 | 4/1980 | Simko | 150/52 R |
| 4,420,097 | 12/1983 | Motsenbocker | 222/131 |
| 4,537,313 | 8/1985 | Workman | 206/545 |
| 4,569,082 | 2/1986 | Ainsworth et al. | 383/110 X |
| 4,578,814 | 3/1986 | Skamser | 383/110 X |
| 4,679,242 | 7/1987 | Brockhaus | 383/110 X |
| 4,738,364 | 4/1988 | Yeager | 206/563 |

*Primary Examiner*—Stephen Marcus
*Assistant Examiner*—Nova Stucker

[57] ABSTRACT

This invention provides an insulated carrier for rectangular cardboard wine and beverage containers which have spigot dispensers. The carrier is a rectangular housing formed by an assemblage of panels. The panels have two outer layers of a flat material, fabric or pliable plastic, encasing at least one inner layer of thermal insulation. The panels, including a top panel, a base panel, a back panel, two side panels, and an openable front panel are attached one to the other along edge seams except for the openable front panel. The openable front panel is attached only on the top edge to the edge of the top panel. Both side edges of the openable front panel are removably attached by zippers to exposed edges of the two side panels and removably fastenable at the bottom edge to an exposed edge of the base panel by Velcro brand fasteners or the equivalent. The openable front panel can be disconnected and lifted for insertion of a rectangular cardboard wine or beverage container with dispensing spigot and a dual hot/cold thermal gel package. An inverted U-shaped opening for passage of the dispensing spigot of the beverage container is opened downwardly centrally in the front of the openable front panel. Looped carrying handles extending above the carrier, formed from a doubled continuous belt affixed along the outside of the carrier side walls and around the outside of the base, make transporting the loaded carrier easy. The entire carrier can be folded, when not in use, for compact storage.

3 Claims, 3 Drawing Sheets

INSULATED BEVERAGE BOX CARRIER

BACKGROUND OF THE INVENTION

1. Field of the Invention

This invention relates to insulated beverage containers and carriers in general. More specifically, the present invention relates to an insulated storage and carrying case for use with rectangular dispensing cardboard beverage containers of the type newly adopted primarily as box-type wine containers.

2. Description of the Prior Art

In recent years, many beverage companies have started marketing drinks such as fruit juices and wines in rectangular cardboard boxes of various sizes. Some of these drinks are sold in boxes that are bulk beverage containers normally for quantities in the one to two gallon range. Because of the weight associated with this large quantity, these beverage containers are sold with dispensing fixtures or spigots conveniently located at the bottom of one side wall. The large capacity of the containers makes them well suited for parties and picnics, and the cardboard construction of the containers is acceptable in parks and beaches where glass bottles or jugs are not allowed. However, the bulk beverage cardboard container has poor insulating qualities and is too large for placement in most conventional ice chests. The present invention is specifically designed as an insulated carrier for these newly marketed box-type cardboard wine and beverage containers. My insulated carrier solves problems connected with both the cooling of the container and use of the dispensing spigot with the beverage container encased in the carrier.

A past art patent search was conducted to disclose patents covering thermal insulated carriers for rectangular cardboard beverage containers having dispensing spigots. As the box-like cardboard wine and beverage containers with attached spigots are a new innovation, no past art patents disclosed coverings actually directed towards these containers. Therefore, I consider my invention to be unique in the field. However, insulated coverings for other containers were examined and they included the past art patents produced from the search found in the following classes and subclasses:

62/530, 457, and 535.

Patents which appeared most pertinent to my invention include the following:

U.S. Pat. No. 1,537,829 for a "Tourist's Flexible Refrigerator" issued to F. M. Kandle on May 12, 1925. This is a canvas bag device for water, ice, and air cooling of drinking water and perishable goods, fish, etc. The flexible bag was equipped with straps for fastening to the spare tire of a car. There is a spigot for drawing water from the ice compartment. The device is a somewhat added to and enlarged version of the typical canvas water bags carried by motorists in prior to World War II days.

The patent issued to L. Eagles for a "Portable Refrigerator Bag" shows a triangular shaped insulated bag with carrying handles coming together at an envelope-like top. The U.S. Pat. No. 2,289,254 and is dated July 7, 1942. This illustrates a typical insulated bag with a single compartment and an insert containing a coolant, in this case dry ice. A top zipper opening is shown and sidewall insulation (material not designated) is illustrated.

The patent issued to Donovan et al, on May 13, 1969, U.S. Pat. No. 3,443,397, discloses a flexible, collapsible container for beer barrels. Insulated walls are illustrated in a bag-like covering. A top zippered opening is shown and the bag has upwardly edgewise carrying handles fastened on two sides. An uninsulated opening is provided downwardly at the front of the bag to allow access to a beer spigot.

The Simko U.S. Pat. No. 4,197,890, dated Apr. 5, 1980, shows a single strap as a carrier for an insulated bottle jacket. The bottle jacket has a zipper attached bottom through which the bottle is inserted.

Motsenbocker, in U.S. Pat. No. 4,420,097, issued Dec. 13, 1983, discloses a "Portable Liquid Dispenser With Carrying Case." A long straw-like dispenser is attached to the container and passes through the case wall. The container proper features interior containment of freezable liquids to maintain a cooled atmosphere inside the container. The container is foldable to some extent.

On Aug. 27, 1985, Workman was issued U.S. Pat. No. 4,537,313, for a rectangular flexible insulated container. Access into the container is through a square zipper attached top. Multi-layer insulation between nylon inner and outer walls is used in a bag-like structure. a combination of Dacron, aluminum foil, and Mylar is described for vapor and thermal barrier use.

The use of BLUE ICE as a coolant is mentioned in U.S. Pat. No. 4,738,364. It describes a "Portable Medicine Protector" and was issued to S. Yeager on Apr. 19, 1988. The use of a freezable coolant is described as a liquid in a compartment attached inside the container.

The use of rectangular cardboard wine and beverage boxes with spigots is a recent innovation. No insulated case suitable for these new square containers was seen in the past art patents. No devices in past art patents examined disclosed or anticipated an insulated carrier for the cardboard wine and beverage boxes coming into use. Many insulated bags like the Donovan device have no inherent thermal insulating means and require the addition of ice or some other coolant for temporarily maintaining coolness in a beverage container. In Donovan's case, a lowered temperature of a beer barrel. Using ice not only adds to the size of the container but also increases the weight. No amount of alterations or combinations would change Simko and Motsenbocker into usable insulated cases for modern box-like beverage carriers. Although the Workman patent shows a squared bag, major changes would be required for his case to service the new squared beverage containers. A BLUE ICE coolant in a liquid state inside a compartment of the case as illustrated in past art devices requires placing the entire bag in a freezer for cooling the liquid. It's far simpler to freeze only a BLUE ICE container bag for insertion into the insulated case as I do with my device. A base positioned side wall spigot like the new rectangular beverage boxes use has to be arranged for in the structure of the insulated carrier for both insertion and removal of the wine or beverage box as well as for use of the spigot with the beverage box in the insulated carrier. The structure of my insulated wine box carrier resolves all of the problems associated with insulated carriers for these new squared wine and beverage containers. How my carrier updates the art with new and unique features is pointed out and fully discussed in the following specification.

SUMMARY OF THE INVENTION

In practicing my invention I have developed an insulated carrier sized for encasing rectangular wine box type dispensing cardboard beverage containers. Carrying straps are provided on the insulated carrier for convenience in transporting the enclosed beverage container, and an opening is provided in the front of the carrier near the base allowing dispensing of the wine or beverage through the dispenser attachment, a built in spigot, without requiring removal of the beverage container from the insulated carrier. The carrier is fabricated in layers of water repellant fabric with inner layers of flexible thermal insulation assembled by conventional sewing means. The materials of manufacture are rigid enough for the carrier to hold its rectangular shape even when empty, yet are flexible enough to be folded. The front panel contains two vertical zippers, one on each side of the panel. The lower edge of the front panel is releasably attached to the base by a short section of hook and loop fasteners such as Velcro brand fasteners, one section attached to the base and two short sections attached to the front panel. The top edge of the front panel is permanently attached to the top panel of the carrier. Positioned centrally on the lower most edge of the front panel is a U-shaped opening designed for passage of the wine box or beverage container dispensing fixture, an outward extending built in spigot. When both zippers are opened the front panel can be detached from the hook and loop fasteners and folded up over the top panel to allow insertion of the rectangular wine box type dispensing beverage container. The carrying handles are formed by two upwardly looped sections of one piece of belting passed along both sides and across the bottom of the carrier and attached to the bottom and the sides of the carrier providing for secure and easy transportation of the loaded carrier. Space is reserved inside the insulated carrier above the beverage container for a small rectangular thermal gel package. Although the thermal gel package prolongs cooling, the carrier can be used to maintain coolness in a prechilled beverage container with or without ther thermal gel package. The thermal gel package used in my invention is a commercially available dual hot/cold unit which can be frozen or heated to cool or heat the contents of my insulated beverage box carrier.

The thermal gel package, however, as used in my case, provides means for cooling the beverage in the cardboard container without the need of conventional ice or an ice chest. Using the thermal gel pack has several advantages. For one thing, the new cardboard packaging used as a beverage container could become damaged by ice and could eventually disintegrates in the water produced by the melting ice. Should the container open or the beverage be released, the contents of the container would be lost and other items in the ice chest could become spoiled. If the only item requiring chilling is the dispensing beverage container, the need for purchasing ice and transporting an over-sized ice chest just for the wine beverage container can be eliminated by using my insulated carrier. Removing water from the melting ice is also avoided.

My carrier eliminates the problems associated with ice chests and other insulated bags not specifically designed for the new box-like beverage containers. My insulated carrier is also lightweight and foldable for easy storage when not in use.

Therefore, it is a primary object of my invention to provide a thermal insulated carrier for rectangular dispensing cardboard beverage containers, particularly wine boxes.

A further object of my invention is to provide an insulated carrier for wine box type dispensing cardboard beverage containers which allows dispensing the wine or beverage through the dispenser attachment, usually a spigot fitting, without removing the beverage container from the insulated carrier.

Another object of my invention is to provide an insulated carrier for wine box type rectangular dispensing beverage containers which is collapsible for compact storage.

A further object of my invention is to provide an insulated carrier for dispensing cardboard packaged beverage containers which is lightweight, has carrying straps, and can be easily transported by one person.

An even further object of my invention is to provide an insulated carrier for wine box type dispensing cardboard packaged beverage containers wherein the insulated carrier is able to maintain the temperature of the container contents for an extended period of time with and without the use of a thermal gel package.

A still further object of my invention is to provide an insulated carrier for cardboard packaged beverage containers which can decrease or increase the temperature of the container contents when the case is used in conjunction with a thermal gel package.

Other objects and the many advantages of my invention will become apparent from reading the specification and comparing the numbered parts described with similarly numbered parts illustrated in the accompanying drawings.

DRAWING REFERENCE NUMBERS

Figure 1:
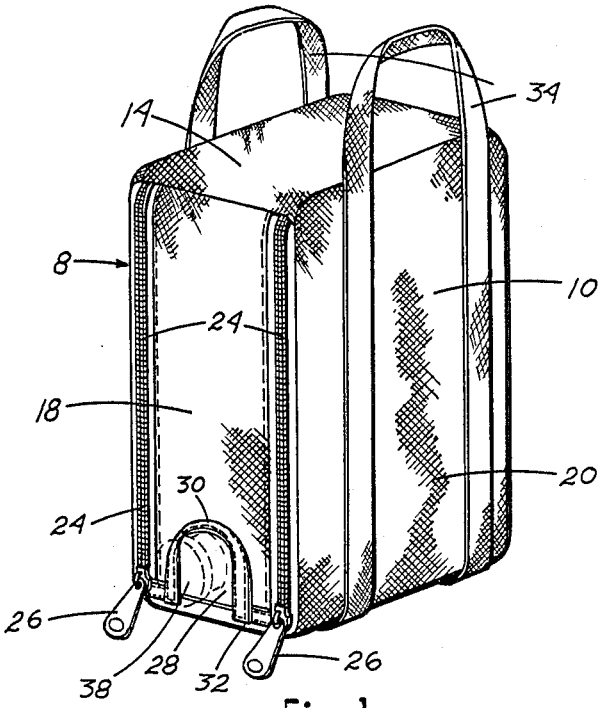
FIG. 1 is a perspective frontal view of the preferred embodiment of the invention.
Figure 2:
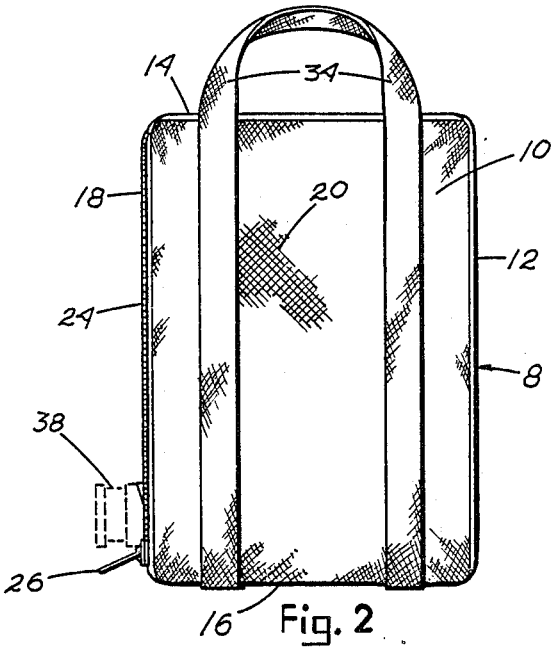
FIG. 2 is a left side view thereof.

8 housing
10 side panel
12 back panel
14 top panel
16 base panel
18 front panel
20 fabric
22 thermal insulation
23 vapor barrier insulation
24 zipper
26 zipper pull tab
28 spigot passage 30 fabric reinforcement
32 hook and loop fasteners
34 carrying handles
36 rectangular beverage container
38 spigot
40 thermal gel package
42 resilient compounded materials

DESCRIPTION OF THE PREFERRED EMBODIMENT

Figure 3:
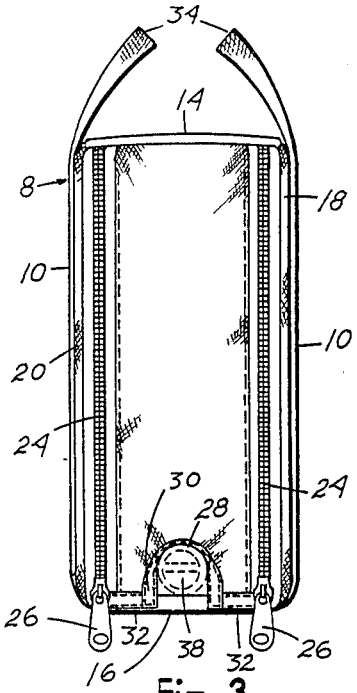
FIG. 3 is a front view thereof.
Figure 4:
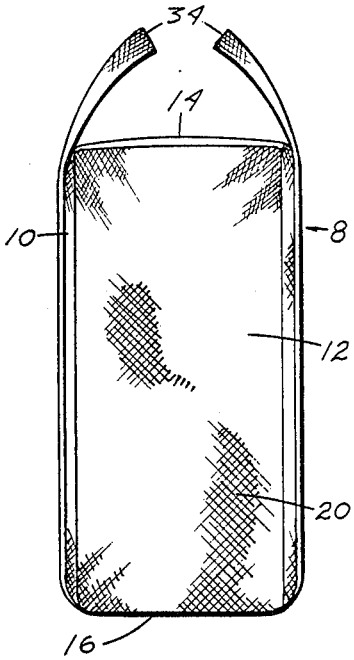
FIG. 4 is a rear view thereof.
Figure 5:
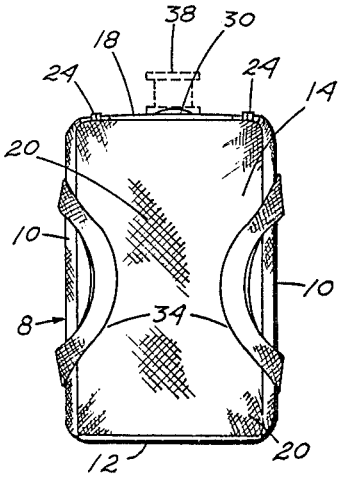
FIG. 5 is a top view thereof.
Figure 6:
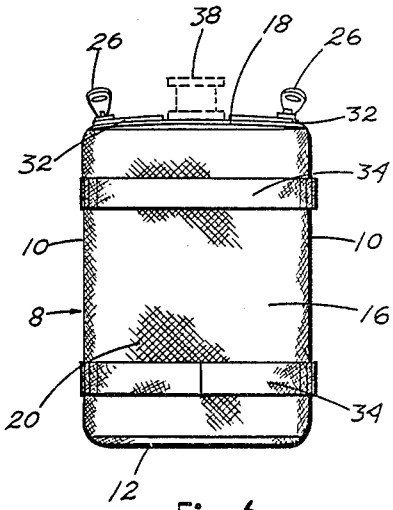
FIG. 6 is a bottom view thereof.

Referring to the drawings a FIG. 1 where the preferred embodiment of the invention is illustrated in a perspective view. The insulated beverage box carrier is comprised of a rectangular fabric housing 8 constructed of two vertical side panels 10, one vertical back panel 12, one horizontal top panel 14, a horizontal base panel 16, and one openable vertical front panel 18. All panels are assembled by conventional sewing into a substantially rectangular housing 8 oriented for vertical alignment longitudinally. Each panel is comprised of two outer layers of durable fabric 20, or other materials which will be mentioned later, with one inner layer of resilient thermal insulation 22, as seen in FIG. 8. Front panel 18 has two vertical zippers 24 positioned one adjacent each side seam, shown in FIG. 1, 3, and 7. In the closed position, each zipper pull tab 26 of each zipper 24 is located on the lower most corners of front panel 18, shown in FIG. 3. The central bottom edge of front panel 18 is affixed with U-shaped spigot passage 28, also seen in FIG. 3, which is rimmed by a narrow strip of fabric reinforcement 30. The bottom inside edge of front panel 18, adjacent each side of spigot passage 28, is affixed with a section of hook and loop fastener 32 (Velcro or similar). There is a corresponding second section of hook and loop fastener 32 affixed in two halves to the front edge of base panel 16, shown in FIG. 1, 3 and 7. The hook and loop fasteners hold the front panel 18 down so spigot passage 28 fits tightly around spigot 38. Carrying handles 34, shown in all FIG., are comprised of one elongated flat rectangular section of flexible strapping material which is formed into one continuous loop. This strapping is sufficiently separated to form handle loops at the top of the carrier housing 8, carrying handles 34, and passes completely around the insulated carrier housing 8 via the side panels to be fastened back to itself on the outside of base panel 16. The strapping forming carrying handles 34 is permanently attached to the exterior of side panels 10 and base panel 16 by adhesive, heat seal or conventional sewing means, depending on the material of manufacture of the carrier.

Figure 7:
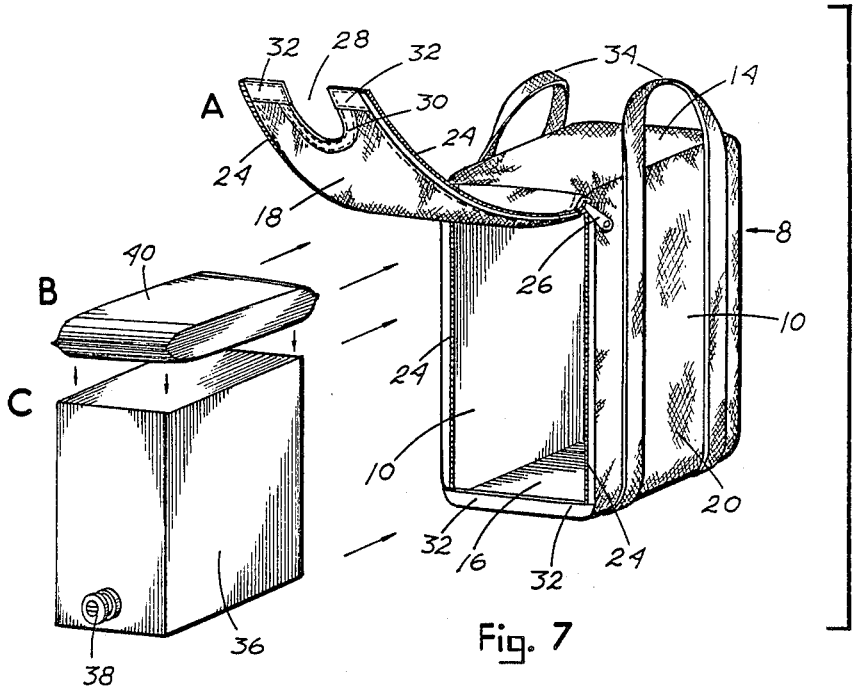
FIG. 7 is an exploded view of the insulated wine box carrier at A, the thermal gel package at B, and the wine box with spigot dispenser at C.
Figure 8:
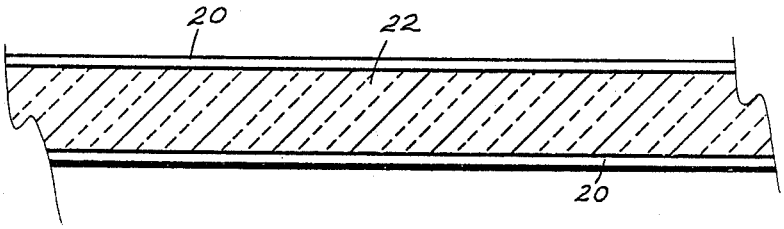
FIG. 8 is a sectioned view of the side wall structure of the carrier housing illustrating fabric external walls encasing a single insulation material.

In use, zippers 24 are opened and front panel 18 is disconnected from hook and loop fasteners 32 of base panel 16, and raised up to allow access into the interior of the carrier, as seen in FIG. 7. Rectangular beverage container 36 is then inserted into the carrier with spigot 38 extending outward through the lower opened front section. Space is reserved above rectangular beverage container 36 and the interior of top panel 14 for insertion of a packaged coolant, thermal gel package 40, also shown in FIG. 7. Front panel 18 is then lowered, and zippers 24 closed with spigot passage 28 fitted over outward extending spigot 38. The hook and loop fasteners 32, best shown in FIG. 7, located on the lower edge of front panel 18 and front of base panel 16 are connected, which then helps to keep any free edges from curling up and interfering with spigot 38 and the dispensing of the container contents.

Although I have illustrated and described the outer covering of my invention as fabric 20, I anticipated the use of resilient compounded materials 42 as the material of manufacture for both side panels 10, back panel 12, top panel 14, base panel 16, and the front panel 18 which constitutes the main housing of the device. These resilient compounded materials 42 include plastics and nylons derivatives which utilize heat sealing of the seams instead of conventional sewing as is used in the structure of my preferred embodiment. Resilient compounded materials 42 are of a non-pervious nature which helps to protect against water damage and also increases the effectiveness of thermal insulation 22 by preventing heat or cold loss through air convection. See FIG. 8.

Figure 9:
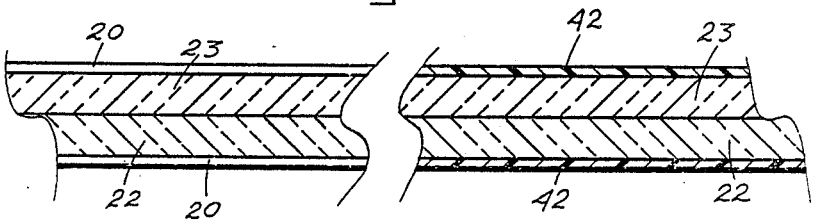
FIG. 9 is a sectional view of the side wall structure of the carrier housing illustrating both fabric side walls and resilient compounded materials used as side walls encasing a thermal insulation and a vapor barrier insulation.

Although a single layer of thermal insulation 22 is quite effective, in some of my carrier structures, a second layer of vapor barrier insulation 23 is added to a thinner layer of thermal insulation 22, which increases the thermal retention capabilities of the insulated beverage box carrier without increasing the thickness of the outer walls. See FIG. 9. Vapor barrier insulation 23 is a thin panel of non-absorbent closed celled foam covered by an outer layer of non-pervious material. Texolite is one brand name of vapor barrier insulation 23 available on the open market, and is distributed by Apex Mills, Corp. of Lyn Brook, NY. This type of insulating is especially effective in my insulated carrier when thermal gel package 40 is not in use.

The main objective of my invention is to maintain the temperature of rectangular beverage container 36 for an extended period of time, preferably after filled rectangular beverage container 36 has first been prechilled by other means. My invention also has the capacity, aided by the use of the previously noted thermal gel package 40, to actually decrease the temperature of the contents of rectangular beverage container 36 or other items contained in my insulated carrier. The thermal gel package 40 which I use in my carrier not only has the capacity to be frozen to decrease temperature, but can also be heated and used to increase the temperature of the contents of the device, as is customary with wines such as Sake.

Although I have described embodiments of my invention with considerable detail in the specification, it is to be understood that I may practice modifications in the structure and design of the invention so long as such changes remain within the scope of the appended claims.

What I claim as my invention is:

1. A thermal insulated beverage box carrier, comprising:

a. a housing; said housing being a substantially rectangular six sided hollow structure sized and arranged for receiving and removably encasing a beverage box with a spigot; said housing an assemblage of panels with said panels each substantially rectangular and fabricated with two layers of a first pliable material encasing at least one layer of flexible thermal insulation; said assemblage of panels including two vertical side panels, one horizontal top panel, one horizontal base panel, one vertical back panel, and one openable front panel; said side panels, said back panel, said top panel, and said base panel seamed edgewardly in permanent attachment one to the other with said openable front panel permanently attached to said top panel upwardly, said openable front panel affixed edgewardly with parallel vertical zippers removably attaching said front panel to two frontwardly exposed edges of said side panels, there being an inverted U-shaped passage opened downwardly centrally in said openable front panel for said spigot, said passage rimmed with reinforcing material, there being removable attachment means for affixing the free ends of said openable front panel adjacent said U-shaped passage to an exposed frontwardly edge of said base panel;

b. carrying handle means attached to said carrier.

2. The thermal insulated beverage box carrier of claim 1, wherein said removable attachment means for affixing said free ends of said openable front panel adjacent said U-shaped passage to said exposed frontwardly edge of said base panel is a hook and loop fastener.

3. The thermal insulated beverage box carrier of claim 1, wherein said carrying handle means is two upwardly looped sections of one piece of belting passed doubled with the two parts separated in paralleling alignment along the exteriors of both said side panels and across the exterior of said bottom panel of said carrier, said belting attached to said bottom panel and said side panels thereof.

* * * * *